US005130718A

United States Patent [19]

Wu et al.

[11] Patent Number: 5,130,718

[45] Date of Patent: Jul. 14, 1992

[54] MULTIPLE DICHROIC SURFACE CASSEGRAIN REFLECTOR

[75] Inventors: Te-Kao Wu, Rancho Palos Verdes; Kenneth C. Kelly, Sherman Oaks, both of Calif.

[73] Assignee: Hughes Aircraft Company, Los Angeles, Calif.

[21] Appl. No.: 601,843

[22] Filed: Oct. 23, 1990

[51] Int. Cl.[5] ..... H01Q 13/00

[52] U.S. Cl. ..... 343/781 CA; 343/909

[58] Field of Search ..... 343/781 CA, 781 R, 781 P, 343/909, 753

[56] References Cited

U.S. PATENT DOCUMENTS

| | | | |
|---|---|---|---|
| 4,636,797 | 1/1987 | Saffold et al. | 343/781 CA |
| 4,701,765 | 10/1987 | Arduini et al. | 343/781 CA |
| 4,814,785 | 3/1989 | Wu | 333/202 |

FOREIGN PATENT DOCUMENTS

| | | | |
|---|---|---|---|
| 0102846 | 3/1984 | European Pat. Off. | 343/781 P |
| 54-114065 | 9/1979 | Japan | 343/781 P |

OTHER PUBLICATIONS

"A Wide Scan Quasi-Optical Frequency Diplexer" by John J. Fratamico, Jr. et al., IEEE Transactions on Microwave Theory and Techniques, vol. MTT-30 No. 1, Jan. 1982.

"Design of a Dichroic Cassegrain Subreflector" by Vishwani D. Agrawal et al., IEEE Transactions on Antennas and Propagation, vol. AP-27, No. 4, Jul., 1979.

*Primary Examiner*—Michael C. Wimer
*Assistant Examiner*—Hoanganh Le
*Attorney, Agent, or Firm*—Leonard A. Alkov; Wanda K. Denson-Low

[57] ABSTRACT

A triplex microwave reflector which includes a primary reflector and a pair of dichroic surfaces disposed between the primary reflector and the focal point of the primary reflector. Each of the dichroic surfaces reflects a specific band of microwave signal frequencies and transmits the others. Microwave signals reflected by one of the dichroic surfaces are focused at a front virtual focal point and microwave signals reflected by the other dichroic surfaces are focussed at a back virtual focal point. Microwave signals transmitted by both the front and back dichroic surfaces are focussed at the primary focal point.

15 Claims, 3 Drawing Sheets

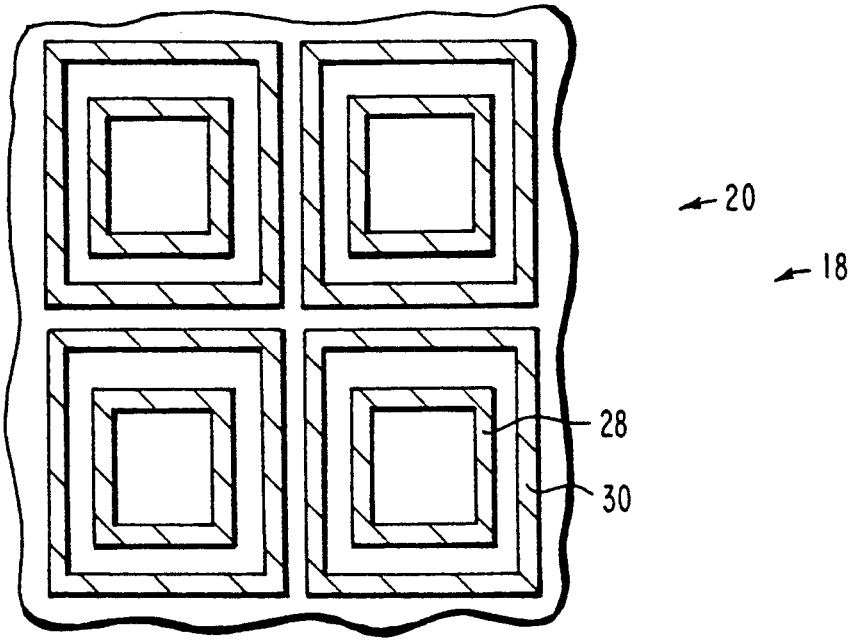
Fig. 5.
Fig. 6.
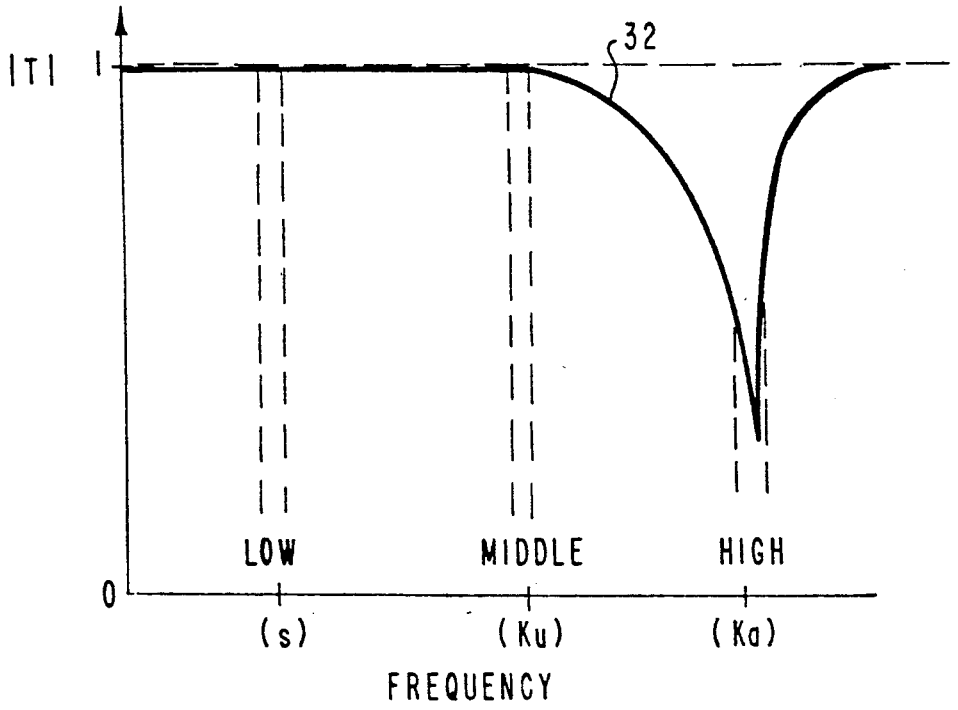

MULTIPLE DICHROIC SURFACE CASSEGRAIN REFLECTOR

BACKGROUND

The present invention relates generally to microwave reflectors and in particular to a microwave reflector incorporating a plurality of frequency selective or dichroic surfaces which selectively reflect and transmit different ones of a plurality of low, middle, and high frequency microwave signals and arranged to focus the low, middle, and high frequency microwave signals at physically displaced focal points.

Hyperbolic microwave reflectors are widely used elements of microwave communication systems. The microwave reflectors are frequently large, heavy, and costly. Size and weight are of particular importance when the microwave reflectors are components of a satellite-borne microwave communication system.

Dichroic surfaces that reflect signals in one frequency band and transmit signals in other frequency bands, have been used as subreflectors in conjunction with a primary microwave reflector for diplexing two widely separated frequency band microwave feeds. Using a dichroic surface, it is possible to separate two frequency bands, such as the S and Ku bands, for example, directing each to a separate feed. This allows microwave feed design to be optimized for each frequency band using a single primary reflector. The dichroic surface may, for example, reflect the Ku band waves and transmit the S band waves. A Ku band feed is placed at the point where the reflected Ku band waves are focused and the S band feed is placed at the location of where the S band waves are focused. Because the two focal points are at physically different locations, microwave feeds of the respective bands may be optimized. Such a diplexer is disclosed in the paper entitled "A Wide Scan Quasi-Optical Frequency Diplexer" by John J. Fratamico, Jr., et al., *IEEE Transactions on Microwave Theory and Techniques,* Vol. MTT-30 No. 1, January, 1982, and in the article "Design of a Dichroic Cassegrain Subreflector" by Vishwani D. Agrawal et al., *IEEE Transactions on Antennas and Propagation,* Vol. AP-27, No. 4, July, 1979.

Advanced communication satellites have been proposed for operation in three frequency bands. For example, the Advanced Tracking and Data Relay Satellite System will operate in the S, Ku, and Ka frequency bands. Other combinations of three frequency bands may also be used. It is desirable to have a microwave reflector which is able to separate the three frequency bands using a single primary reflector. Such a reflector will substantially reduce space and weight requirements in a satellite system.

It is therefore an objective of the present invention to provide a microwave reflector incorporating multiple dichroic surfaces capable of efficient operation in multiple frequency microwave communications systems. Another objective of the invention is to provide a microwave reflector in which dichroic surfaces are positioned between a microwave reflector and its focal point to selectively reflect and transmit different ones of a plurality of microwave signals, each in a different frequency band, and to direct the reflected and transmitted microwave signal to and from physically displaced focal points. Still another objective of the invention is to provide a microwave reflector capable of efficient triplex operation. Yet another objective of the invention is to provide a microwave reflector capable of triplex operation using a single parabolic primary reflector. Another objective o the invention is to provide a microwave reflector for us in multiple frequency satellite communication systems.

SUMMARY OF THE INVENTION

Broadly, the invention is a microwave reflector for transmitting and receiving microwave signals in three frequency displaced frequency bands which for convenience are herein referred to as low, middle, and high frequency signals. The reflector comprises a primary reflector having a primary focal point. A front dichroic surface is positioned between the primary reflector and the primary focal point. The front dichroic surface reflects one of the low, middle, and high frequency signals and passes or transmits the other. A back or second dichroic surface is positioned between the front dichroic surface and the primary focal point. The second dichroic surface reflects another of the low, middle, and high frequency signals and transmits the others.

Microwave signals reflected by the front dichroic surface are focused at a front virtual focal point. Microwave signals reflected by the back dichroic surface are focused at a back virtual focal point that is physically displaced from the front virtual focal point. Microwave signals transmitted by the front and back dichroic surfaces are focused at the primary focal point. A microwave feed is positioned at the front and back virtual focal points and at the primary focal point, and each microwave feed is adapted for optimum operation at the microwave frequency focused thereon.

In a specific embodiment of the invention, the front and back dichroic surfaces may be hyperbolic surfaces having different magnification factors to facilitate increased physical displacement of the front and back virtual focal points.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 5 is an illustration of a portion of a dichroic surface suitable for use as the front dichroic surface of the invention; and FIG. 6 is a diagram showing the transmission characteristics of the dichroic surface of FIG. 5.

DETAILED DESCRIPTION

Figure 1:
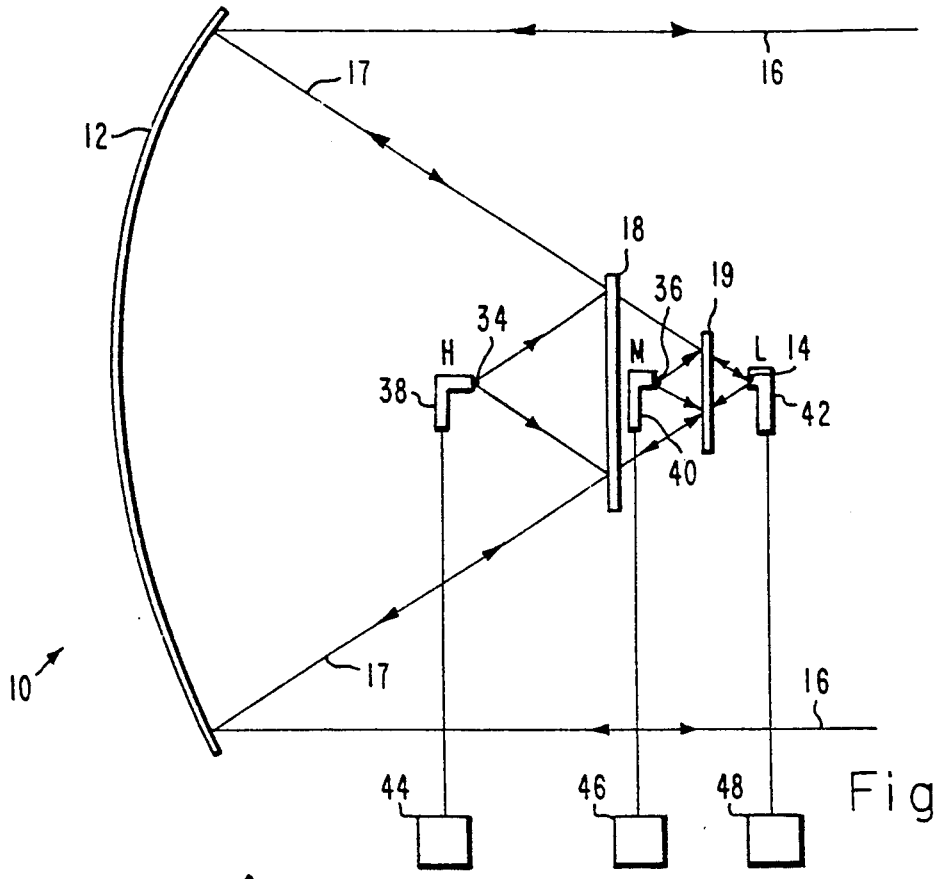
FIG. 1 is an illustration of a triplex microwave reflector in accordance with the invention using planar dichroic surfaces.

Referring now to FIG. 1, there is shown a microwave reflector 10. The reflector 10 includes a primary reflector 12. Typically, the primary reflector 12 is provided with a hyperbolic surface adapted to reflect a wide frequency band of microwave signals 17. The microwave signals 17 received by the primary reflector 12 are focused at a primary focal point 14. Microwave signals emitted at the focal point 14 and incident on the primary reflector 12 are concentrated into a beam represented by ray lines 16.

A front frequency selective dichroic surface 18 is positioned between the primary reflector 12 and the primary focal point 14. A back frequency selective dichroic surface 19 is positioned between the front dichroic surface 18 and the primary focal point 14.

Figure 3:
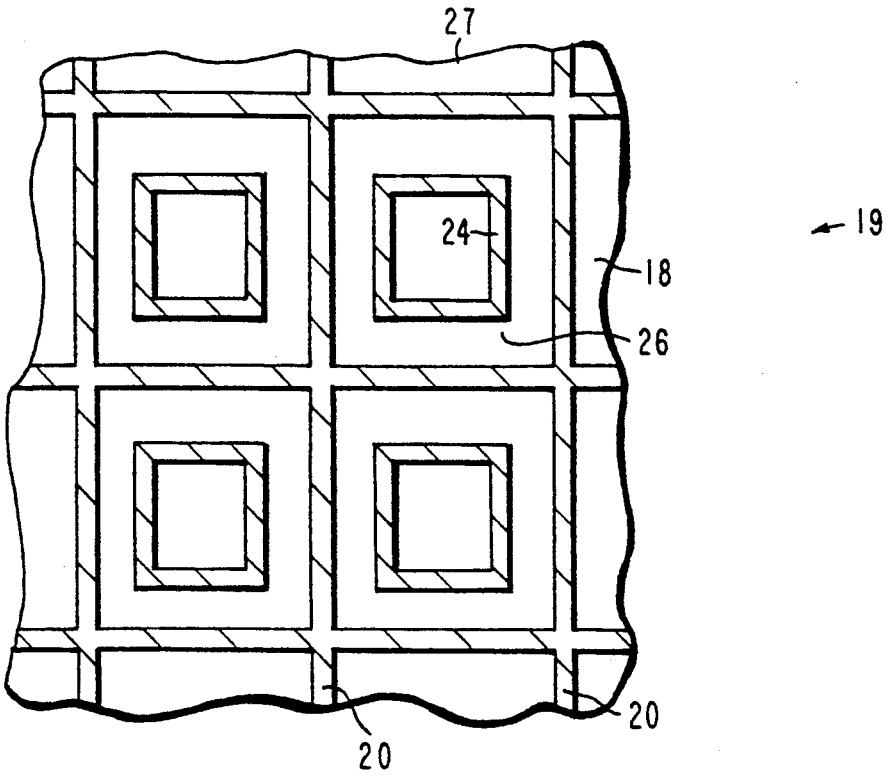
FIG. 3 is an illustration of a portion of a dichroic surface suitable for use as a back dichroic surface of the invention.
Figure 4:
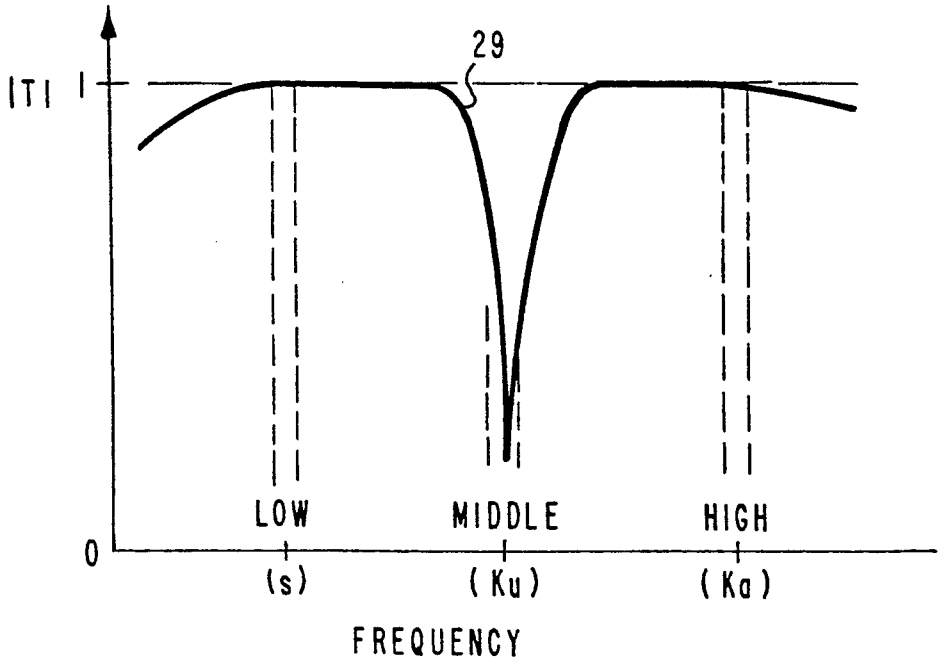
FIG. 4 is a diagram showing the transmission characteristics of the dichroic surface of FIG. 3.

The back dichroic surface 19 may have a configuration shown in FIG. 3. The back dichroic surface 19 includes a square grid of connected vertical and horizontal (as viewed in the drawing) conductive elements 20, 22. Square, open centered conductive elements 24 are located within each square grid opening 26 defined by the conductive elements 200, 22. The square, open centered conductive elements 24 are conductively separated from the vertical and horizontal elements 20, 22. All of the elements 20, 22, 24 may be formed by etching a copper film supported on a thin Kapton sheet 28. The transmission characteristic of each back dichroic surface 19 as a function of frequency is shown in FIG. 4. A chart line 29 indicates the magnitude of signals reflected by the back dichroic surface 19. It will be appreciated that the back dichroic surface 19 transmits a major portion of low frequency (S band) and high frequency (Ka band) microwave signals while reflecting substantially all of the middle (Ku band) signals. A more detailed description of a such a dichroic surface is given in commonly assigned U.S. Pat. No. 4,814,785 issued to Te-Kao Wu dated mar. 21, 1989, the teachings of which are incorporated herein by reference.

The front dichroic surface 18 may have the configuration illustrated in FIG. 5. The front dichroic surface 18 comprises a grid of conductively isolated open square inner and outer conductor elements 28, 30. The outer conductor elements 30 have a relatively large perimeter and enclose the inner conductor elements 28. The transmission characteristic of the front dichroic surface 18 is shown in FIG. 6, and a chart line 32 indicates the magnitude of the transmitted signal. The front dichroic surface 18 transmits a major portion of the low and middle frequency signals in the S and Ku bands and reflects substantially all of the high frequency signals in the Ka band. A more detailed description of a suitable front dichroic surface 18 is given in copending U.S. patent application Ser. No. 07/601,844, filed oct. 23, 1990 entitled "Polarization Independent Frequency Selective Surface for Diplexing Two Closely Spaced Frequency Bands", which is assigned to the assignee of the present invention. The disclosure of this copending patent application is incorporated herein by reference.

Referring again to FIG. 1, the high frequency microwave signals normally focused at the primary focal point 14 are reflected by the front dichroic surface 18 and are focused at a front virtual focal point 34. The middle and low frequency microwave signals are transmitted through the front dichroic surface 18. The middle frequency microwave signals transmitted through the front dichroic surface 18 are reflected by the back dichroic surface 19 and are focused at a back virtual focal point 36. The low frequency microwave signals are transmitted through the back dichroic surface 19 and are focused at the primary focal point 14.

A high frequency microwave feed 38 is positioned at the front virtual focal point 34. A middle frequency microwave feed 40 is positioned at the back virtual focal point 36 and a low frequency microwave feed 42 is positioned at the primary focal point 14. Each of these microwave feeds 38, 40, 42 is adapted for optimum reception of the microwave signals of the frequency focused thereat. The microwave feeds 38, 40, 42 are connected in a conventional manner to appropriate microwave transmitting and receiving apparatus 44, 46 and 48, respectively, in a manner well known to those skilled in the art.

Conversely, the high frequency microwave signals emitted by the microwave feed 38 are reflected by the front dichroic surface 18 onto the primary reflector 12 and formed into the microwave beam indicated by ray lines 16. Similarly, the middle frequency microwave signals emitted at middle frequency microwave feed 36 are reflected by the back dichroic surface 19, transmitted through the front dichroic surface 18 onto the surface of the primary reflector 12, and are focused into a microwave beam indicated by ray lines 16. Low frequency microwave signals emitted by the low frequency microwave feed 42 are transmitted through the back dichroic surface 19 and front dichroic surface 18 onto the primary reflector 12 and are formed into the microwave beam indicated by lines 16.

It will thus be appreciated that the microwave reflector 10 of FIG. 1 provides an effective microwave reflector for transmitting and receiving microwave signals in three frequency separated frequency bands using a single primary reflector and a pair of dichroic surfaces. The microwave reflector 10 performs its function with maximum efficiency by enabling the use of three microwave feeds 38, 40, 42 optimized for the specific frequencies of the low, middle, and high frequency signals.

Figure 2:
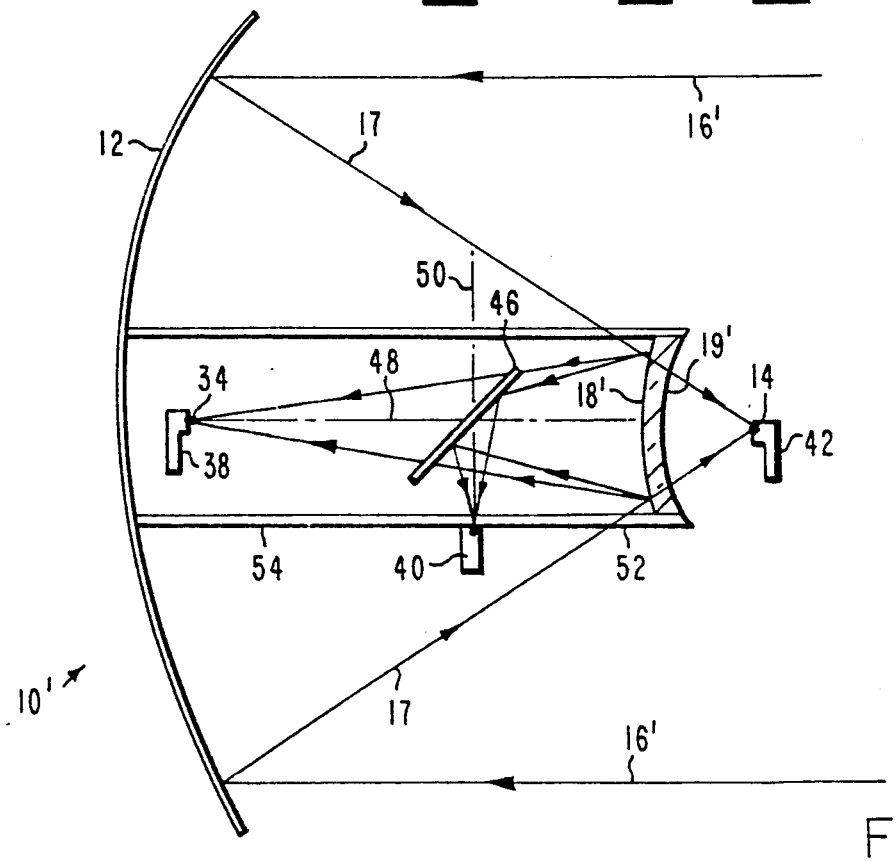
FIG. 2 is an illustration of a microwave reflector in accordance with the invention incorporating hyperbolic dichroic surfaces.

Referring now to FIG. 2, wherein like numerals refer to like elements and similar elements are indicated by like numerals primed, there is shown a second embodiment of a microwave reflector 10' in accordance with the invention. In this embodiment, the primary reflector 12 again has a primary focal point 14. In this embodiment, the front dichroic surface 18' and the back dichroic surface 19' are hyperbolic surfaces. The front dichroic surface 18' may again have the configuration and transmission characteristic as shown in FIG. 5 and 6 and the back dichroic surface may have the configuration and transmission characteristic of the dichroic surface shown in FIGS. 3 and 4. The hyperbolic dichroic surfaces 18' and 19' enable further control of the physical separation of the first and second virtual focal points 34, 36. This is effected buy providing the front dichroic surface 18' and the back dichroic surface 19' with curvatures that produce different magnification factors. These magnification factors are adjustable over a wide range in accordance with the physical requirements of the reflector 10'.

A further degree of versatility int he location of the high and middle frequency feeds 38, 40 is effected by positioning a third dichroic surface 46 between the front dichroic surface 18' and the first virtual focal point 34. The dichroic surface 46 is disposed at an angle, typically 45 degrees, to an optical axis 48 through the front and back dichroic surfaces 18' and 19' and may have a complementary configuration such as the dichroic surface shown in FIG. 5. Accordingly, the third dichroic surface 46 transmits high frequency microwave signals and reflects middle and low frequency microwave signals. This results in separating the high and middle frequency microwave signals and directing them along different axes 48, 50. While the third dichroic surface 46 is shown as planar in FIG. 2, it will be appreciated that the surface may also be provided as a hyperbolic surface further enlarging the ability of the reflector 10' to focus low, middle, and high frequency microwave signals at physically displaced primary, and front and back virtual focal points.

The front and back dichroic surfaces 18', 19' may be formed by bonding the etched copper and Kapton dichroic surfaces of FIGS. 3 and 5 to oppositely disposed hyperbolic surfaces comprised of a lightweight rigid foam or composite body 51. The oppositely disposed surface of the body 51 is formed as required to provide the desired magnification factors for the front and back dichroic surfaces 18' and 19'. The body 51 may be supported within the distal end 52 of a microwave transmissive plastic tube 54 secured at its proximal end 56 to the primary reflector 12. It will be appreciated that the size and weight of the dichroic surfaces 18, 19 or 18', 19' and supporting members may be very small compared to the size and weight of the primary reflector 12.

Thus there has been described a new and improved triplex microwave reflector having dual dichroic surfaces for receiving and transmitting microwave signals at three different frequencies. The reflector performs this function using a single paraboloid reflector and a pair of dichroic surfaces positioned between the primary reflector and its primary focal point.

It is to be understood that the above-described embodiment is merely illustrative of some of the many specific embodiments which represent applications of the principles of the present invention. It is to be understood that additional dichroic surfaces may also be employed along with their associated feeds to permit the transmission and reflection of additional frequency bands of microwave radiation, and that the present invention is not limited to only three frequency bands. Clearly, numerous and other arrangements can be readily devised by those skilled in the art without departing from the scope of the invention.

What is claimed is:

1. A microwave reflector for transmitting and receiving low, middle, and high frequency microwave signals, the reflector comprising:

a primary reflector having a primary focal point;

front dichroic surface means disposed between the primary reflector and the primary focal point for reflecting and focusing one of the low, middle, and high frequency microwave signals at a front virtual focal point and transmitting the others of the low, middle, and high frequency microwave signals;

back dichroic surface means positioned between the front dichroic surface means and the primary focal point for reflecting and focusing another of the low, middle, and high frequency microwave signals at a back virtual focal point and transmitting the others of the low, middle, and high frequency signals; and microwave feed means positioned at each of the front and back virtual focal points and the primary focal point to receive and emit the one of the low, middle, and high frequency microwave signals, the other of the low, middle, and high frequency microwave signals, and the remaining one of the low, middle, and high frequency signals, respectively.

2. The reflector of claim 1 further including means connected to low and high, microwave feed means for receiving and emitting the low, middle and high frequency microwave signals, the primary reflector concentrating microwave signals emitted from emitter means and respective ones of the microwave feed means into substantially coincident beams of low, middle, and high frequency microwave signals.

3. The reflector of claim 2 wherein the front dichroic surface means is a hyperbolic frequency selective surface having a first predetermined magnification factor.

4. The reflector of claim 3 wherein the back dichroic surface means is a hyperbolic frequency selective surface having a second predetermined magnification factor different than the first predetermined magnification factor.

5. The reflector of claim 4 wherein the front virtual focal point is located between the front dichroic surface means and the primary reflector, and the back virtual focal point is located between the front dichroic surface means and the back dichroic surface means.

6. The reflector of claim 4 further including a secondary dichroic surface means angularly disposed between the front and back dichroic surface means and the front and back virtual focal points for transmitting microwave signals reflected by the front dichroic surface means and reflecting microwave signals reflected by the back dichroic surface means at an angle with respect to optical axes of the front and back dichroic surface means.

7. The reflector of claim 6 wherein the front and back dichroic surface means are secured to a rigid low density foam body having front and back surfaces that correspond to the hyperbolic surfaces of the dichroic surface means.

8. The reflector of claim 7 further including a hollow microwave transmissive plastic tube secured at one end to the primary reflector, and wherein the front and back dichroic surface means are supported distally from the primary reflector within the plastic tube.

9. The reflector of claim 1 wherein the primary reflector is a broadband paraboloid microwave reflector.

10. The reflector of claim 9 wherein the front and back dichroic surface means are substantially smaller than the primary reflector.

11. The reflector of claim 10 wherein the front and back dichroic surfaces include a grid of conductor elements bonded to a polyimide substrate, and wherein the pattern of the grid of conductor elements is adapted to reflect one and transmit the others of the low, middle, and high frequency signals.

12. The reflector of claim 11 wherein the back dichroic surface includes a grid of conductor elements bonded to a polyimide substrate, and wherein the pattern of the grid of conductor elements is adapted to reflect another and transmit the others of the low, middle, and high frequency signals.

13. A Cassegrain reflector for transmitting and receiving low, middle, and high frequency microwave signals, the reflector comprising:

a primary reflector having a primary focal point;

a plurality of dichroic surfaces disposed between the primary reflector and the primary focal point, each surface reflecting and focusing a selected one of a plurality of the low, middle, and high frequency microwave signals at a respective virtual focal point of a plurality of virtual focal points and for transmitting the other frequency signals comprising the low, middle, and high frequency microwave signals; and microwave feed means positioned at each of the plurality of virtual focal points and at the primary focal point for receiving and emitting the low, middle, and high frequency microwave signals, respectively.

14. A Cassegrain antenna system for operation in three frequency bands, said antenna system comprising:

a paraboloidal main reflector for transmitting and receiving low, middle and high frequency signals and having a focal point;

a hyperboloidal dichroic subreflector disposed at the focal point of the paraboloidal main reflector, said subreflector comprising a low density foam block having a front frequency selective surface and a back frequency selective surface;

a plastic tube rigidly affixed to said main reflector at one end thereof and having said subreflector affixed to the other end thereof;

a planar dichroic reflector disposed in said plastic tube intermediate said primary reflector and said subreflector;

a low frequency feed disposed at a focal point in front of said subreflector;

a middle frequency feed disposed within said plastic tube along a reflective path from said planar dichroic reflector; and a high frequency feed disposed within said plastic tube and along a transmissive axis through said planar dichroic reflector.

15. The Cassegrain antenna system of claim 14 in which the front frequency selective surface passes low frequency signals and high frequency signals and reflects middle frequency signals, and in which the back frequency selective surface passes low frequency signals and middle frequency signals and reflects high frequency signals.

* * * * *